US006835144B2

(12) United States Patent
Best

(10) Patent No.: US 6,835,144 B2
(45) Date of Patent: Dec. 28, 2004

(54) GOLF CLUB HEAD WITH FILLED RECESS

(75) Inventor: Christopher B. Best, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 15 days.

(21) Appl. No.: 10/289,597

(22) Filed: Nov. 7, 2002

(65) Prior Publication Data

US 2004/0092331 A1 May 13, 2004

(51) Int. Cl.[7] ..... A63B 53/04
(52) U.S. Cl. ..... 473/332; 473/349; 473/350
(58) Field of Search ..... 473/324, 329, 473/332, 333, 334, 335, 336, 337, 338, 339, 345, 347, 348, 349, 350; D21/747, 748, 749, 750, 751, 759

(56) References Cited

U.S. PATENT DOCUMENTS

| | | | | | |
|---|---|---|---|---|---|
| 2,846,228 | A | * | 8/1958 | Reach | 473/332 |
| 4,398,965 | A | * | 8/1983 | Campau | 148/522 |
| 4,824,110 | A | * | 4/1989 | Kobayashi | 473/332 |
| 4,928,972 | A | * | 5/1990 | Nakanishi et al. | 473/332 |
| 4,964,640 | A | * | 10/1990 | Nakanishi et al. | 473/335 |
| 5,290,036 | A | * | 3/1994 | Fenton et al. | 473/332 |
| 5,348,302 | A | * | 9/1994 | Sasamoto et al. | 473/346 |
| D353,644 | S | | 12/1994 | Hirsch et al. | |
| 5,425,535 | A | | 6/1995 | Gee | |
| 5,588,923 | A | | 12/1996 | Schmidt et al. | |
| 5,590,881 | A | * | 1/1997 | Jernigan | 473/324 |
| 5,707,302 | A | * | 1/1998 | Leon et al. | 473/324 |
| 5,766,092 | A | * | 6/1998 | Mimeur et al. | 473/329 |
| D401,637 | S | | 11/1998 | Best et al. | |
| 5,899,821 | A | * | 5/1999 | Hsu et al. | 473/332 |
| 6,027,415 | A | | 2/2000 | Takeda | |
| 6,030,293 | A | * | 2/2000 | Takeda | 473/334 |
| 6,042,486 | A | | 3/2000 | Gallagher | |
| 6,120,388 | A | | 9/2000 | Blough et al. | |
| 6,206,790 | B1 | | 3/2001 | Kubica et al. | |
| 6,210,290 | B1 | | 4/2001 | Erickson et al. | |
| D453,949 | S | | 2/2002 | Helmstetter et al. | |

* cited by examiner

*Primary Examiner*—Sebastiano Passaniti
(74) *Attorney, Agent, or Firm*—D. Michael Burns

(57) ABSTRACT

A golf club head having a cavity back design with a recess therein for placement of a lightweight polymer material. The club head having a back surface of a club face. The polymer material only bonded to the recess by its perimeter with a predetermined void between the polymer and the back surface of the club face. The lightweight material allows for a larger club head and consequently a bigger sweet spot without increasing the overall weight of the club head. Unwanted vibrations caused upon the club head hitting a golf ball are dampened by a spring/mass system. The polymer material serves as the spring and a decorative medallion, which is attached only to the polymer and not the club head, provides the mass. Vibrations created by contact between club head and golf ball are dampened in accordance to material characteristics of the selected polymer.

9 Claims, 3 Drawing Sheets

GOLF CLUB HEAD WITH FILLED RECESS

FIELD OF THE INVENTION

The present invention generally relates to golf clubs and, more particularly to cavity back irons filled with vibration dampening material.

BACKGROUND OF THE INVENTION

The individual golf club heads in a set typically increase progressively in strike face surface area and weight as the clubs progress from the long irons to the short irons. Therefore, the club heads of the long irons have a smaller strike face surface area than the short irons and are typically more difficult for the average golfer to hit consistently well. For conventional club heads, this arises at least in part due to the smaller sweet spot of the corresponding smaller strike face.

To help the average golfer consistently hit the sweet spot of a club head, many golf clubs are available having heads with so-called cavity back designs with increased perimeter weighting. Another more recent trend has been to simply increase the overall size of the club heads, especially in the long irons. Each of these features will increase the size of the sweet spot and therefore make it more likely that a shot hit slightly off the center of gravity of the club head still makes contact with the sweet spot and flies farther and straighter as a result. One challenge for the golf club designer when maximizing the size of the club head concerns maintaining a desirable and effective overall weight of the golf club. For example, if the club head of a three iron is increased in size and weight, the club may become difficult for the average golfer to properly swing.

Another problem area for the average golfer is that of excess vibration resulting from an off center impact with the golf ball. Various types of vibration dampening have been incorporated into club heads to absorb these impact vibrations. However, there is still a need for improvement in the areas of weight redistribution, vibration dampening in golf club heads, and especially improving the sound and feel upon striking the golf ball. A significant need is to provide a golf club head that is more tolerant to a golfer's inadvertent misplacement of the front hitting surface upon contact with the ball. In addition to inaccuracy of the shot, vibrations are indicative of a less than ideal transfer of energy from the club to the ball, and consequently represent inefficiency in the club head.

A number of golf club manufacturers have developed golf clubs that attempt to reduce the transmission of vibration up the shaft of the golf club. A manufacturer of golf club shafts called TRU-TEMPER, for example, has placed a polymer or sponge-like material in the shaft. This particular product, known as SENSICORE™, is helpful, but suffers from the fact that it merely attempts to dampen vibration that has already been transmitted to the shaft.

There remains a significant need, therefore, for a golf club head that is more accurate and more forgiving and which more efficiently dampens the transmission of shock vibrations from the golf club head to the shaft.

SUMMARY OF THE INVENTION

Conceptually, the invention includes a recess in the cavity portion of a golf iron club head that is filled with a polymer material. This design accomplishes several things. First, it allows the head to have a larger volume for a given amount of weight, in that the polymer adds very little weight to the iron club head relative to the volume added. Secondly, it provides a unique way of attaching a medallion to a club head. And thirdly, it creates a spring/mass method for dampening undesirable vibrations, where the polymer is the spring and the medallion the mass.

The recess for the insertion of the polymer is preferably formed in the main body structure of the golf club head during the casting or forging process, but may also be formed subsequently by machining. Because the polymer that fills the recess is less dense than the metal material that would have filled the recess, the mass moment of inertia of the golf club is actually increased.

Additionally, ideally the polymer material is an epoxy, polyurethane or similar formable polymer that exhibits positive adherence characteristics to the main body structure of the club head. In the current preferred embodiment, once the main body structure of the golf club head has been formed, such as by investment casting, the polymer is preferably pre-formed and adhesively attached to the recess. While the actual type and make up of the material used for the recess filler is not critical, it must exhibit the properties of resiliency and elasticity. Consequently, other types of materials could be substituted for the polymer.

DETAILED DESCRIPTION OF THE PREFERRED EMBODIMENTS

Figure 1:
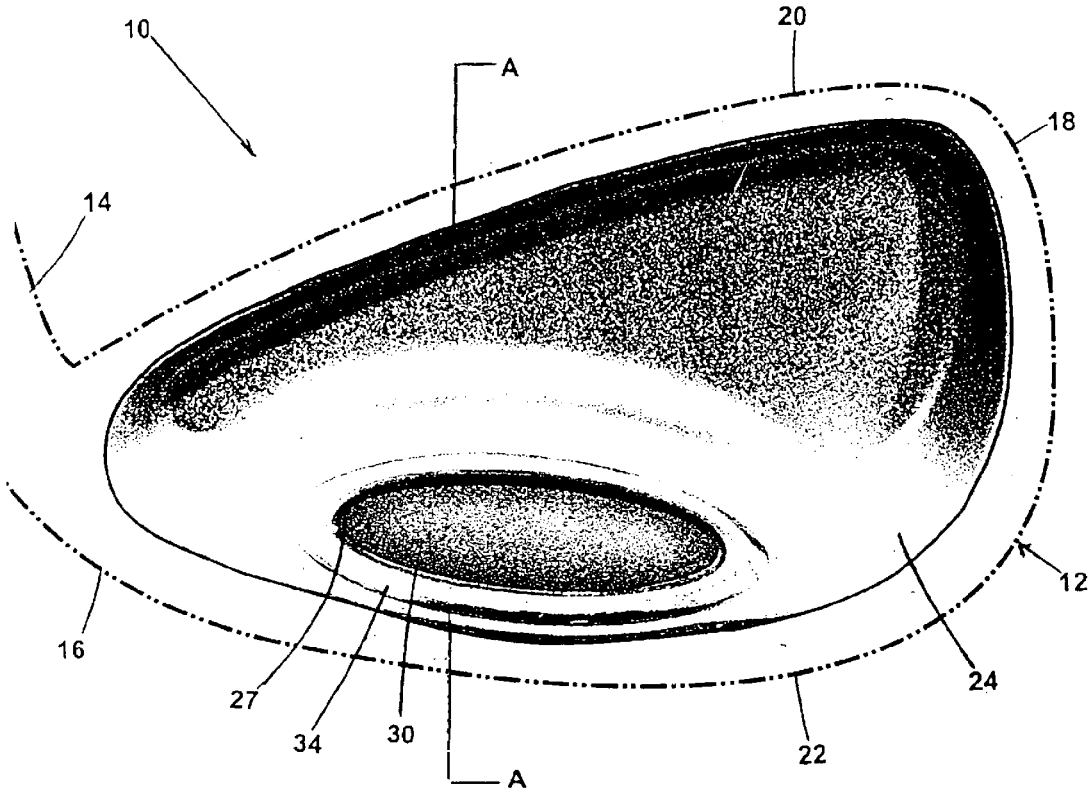
FIG. 1 is a back perspective view of a golf club head according to my new design.
Figure 2:
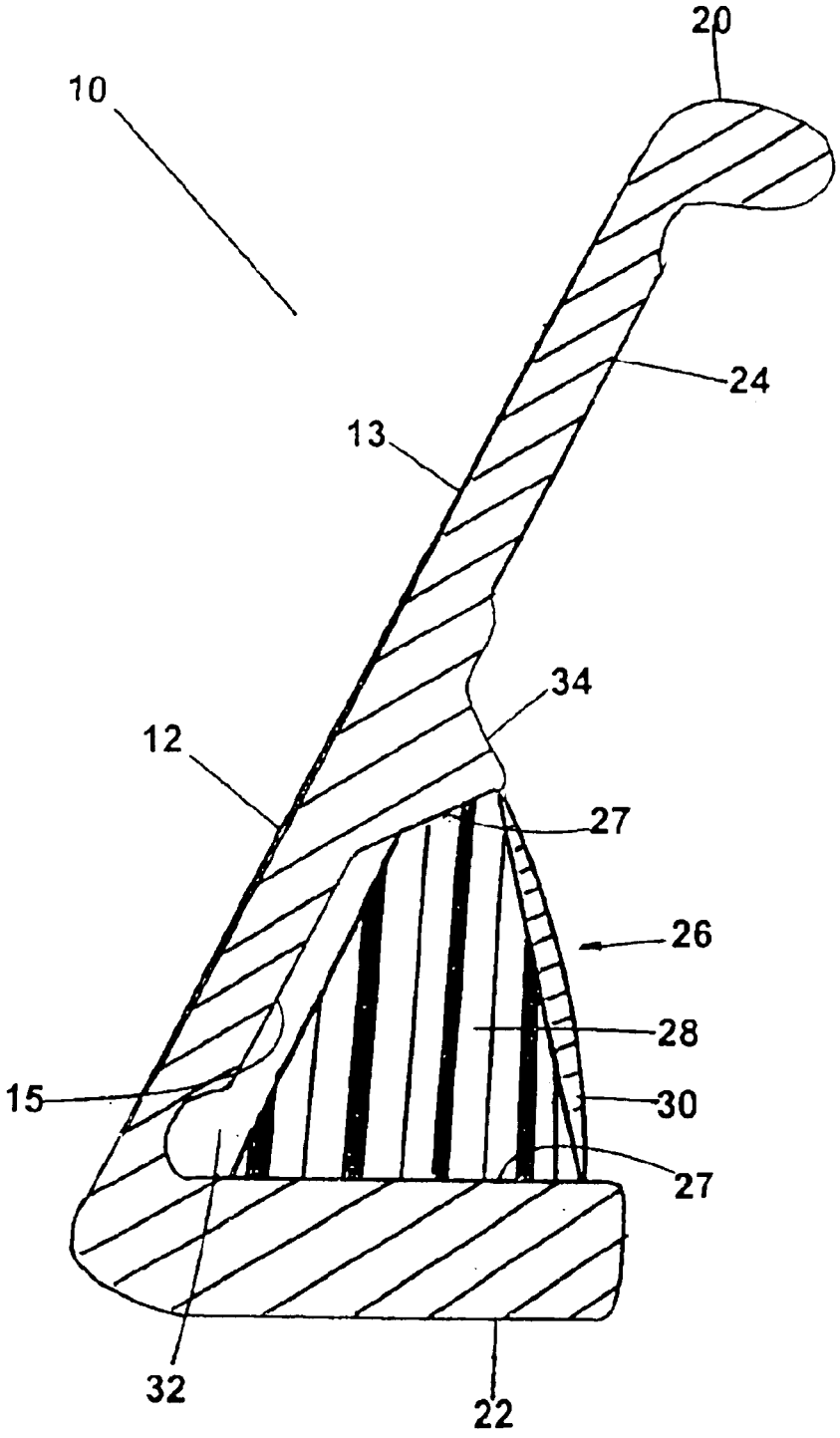
FIG. 2 is a sectional view taken along lines A—A in FIG. 1.

Referring to FIGS. 1–2, golf club head 10 is constructed in accordance with a preferred embodiment of this invention. It includes a cavity back club head body 12 having a club face 13, a back portion 24, a hosel portion 14, a heel portion 16, a toe portion 18, an upper edge 20 and lower edge 22. The back portion 24 includes a recess 26 that is defined by a perimeter wall 27 and a back surface 15 of the club face 13.

In the preferred embodiment, as described in FIG. 2, recess 26 is preferably formed in the main body structure 12 during the casting process, but may also be formed subsequently by machining. Recess 26 is partially filled with a polymer material 28 that may be a preformed insert. The polymer 28 is attached only to the perimeter wall 27 of the recess 26 and is purposely not attached to the back surface 15 of the club face 13, thereby leaving a predetermined void 32 therein. The attaching method preferably bonding with an adhesive. A decorative medallion 30, possibly with a logo or some form of indicia on the outer wall, is attached directly to the polymer 28 and not to the body 12 of the head 10. This creates a spring/mass type of vibration dampening, wherein the spring is represented by the polymer material 28 and the mass by the medallion 30. Upon impact of club head 10 and a golf ball, the spring/mass effect will cause the polymer 28 and medallion 30 to react and vibrate, such that unwanted vibrations are dampened with respect to the shear properties of the polymer material. This dampening absorbs some of the vibration from impact that would have been felt by the golfer. It also absorbs some of the impact noise.

Since the polymer 28 is less dense than the metal material that would have filled the recess 26, the mass moment of inertia of the golf club head 10 is increased. Ideally, the polymer material 28 can be an epoxy, polyurethane or similar formable polymer that exhibits positive adherence characteristics to the main body structure 12 of the club head 10. Also, a material exhibiting thermoset properties is highly desirable. It is preferred that the polymer material exhibit an intrinsic damping coefficient between about 0.01 and 0.4 when tested at 1 Hz and 100 microns. It is more preferred that the intrinsic damping coefficient be between about 0.01 and 0.3 when tested at the same parameters. It is also preferred that the polymer material 28 have a Shore C hardness between about 30 to 90, and more preferred that it be between about 40 to 60. The preferred Shore D hardness for the polymer 28 is less than about 60 and, more preferably less than about 50. The preferred flexural modulus for the material 28 is less than about 50,000 psi and more preferable less than about 30,000 psi. A glass transition temperature of greater than 250° F. is preferred for the insert material and a transition temperature of greater than 200° F. is more preferred.

Substituting the lightweight polymer material 28, in lieu of a denser metal material, allows for the club head 10 to be larger without increasing its overall weight. Preferably, the material has a specific gravity of less than about 2 and, more preferably, less than about 1.5. Preferably, the medallion 30 has a specific gravity greater than the polymer 28. More preferably, the specific gravity of the medallion is greater than about 4.

This provides for an iron to have a larger sweet spot and thereby inherently making it easier to hit. A ring 34 can be formed separately to hold the polymer 28 in place or can be integrally cast as part of the body 12.

Figure 3:
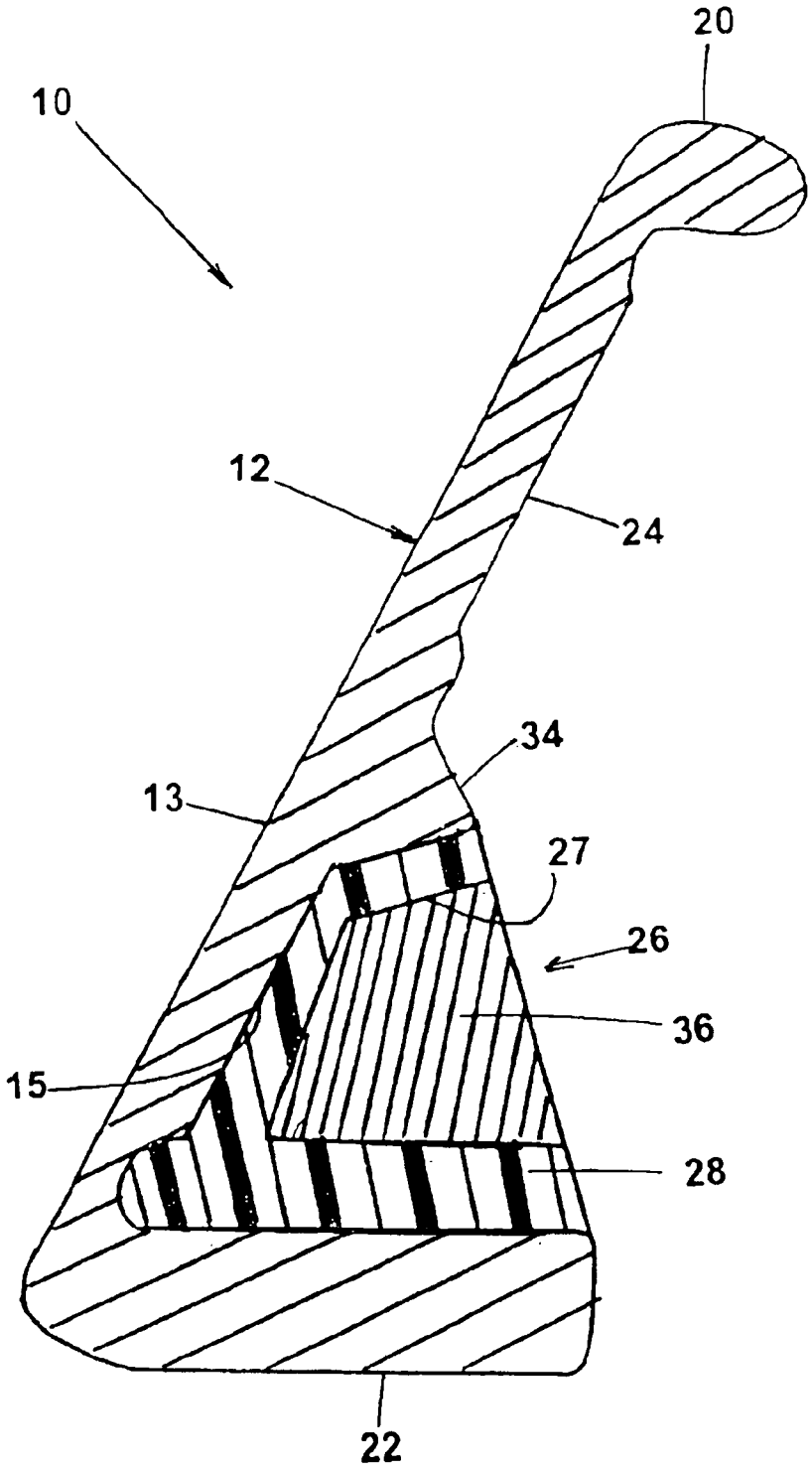
FIG. 3 is a sectional view, of another embodiment, taken along lines A—A of FIG. 1.

An embodiment of the invention is described in FIG. 3, wherein polymer material 28 supports a weight member 36, to create a dampening effect by a similar spring/mass system acting in shear, but without the predetermined void 32. As in the preferred embodiment, the perimeter of polymer material 28 is bonded to the wall 27 of the recess 26. However, it can also be attached to the back surface 15 of the club head 12. Upon impact of club head 10 and a golf ball, weight member 36 will react and vibrate and as did the medallion 30 above. Preferably, the weight member 36 has a specific gravity greater than the polymer material. Even more preferably, the weight member 36 has a specific gravity equal to or greater than the club head 12. Thus, the vibration will also be dampened with respect to the shear properties of the polymer material. Preferable weight materials are set forth below:

| Metal | Density (g/cm3) |
|---|---|
| Ti | 4.5 |
| W | 19.4 |
| Cu | 8.9 |
| Ni | 8.9 |
| Fe | 7.9 |
| Al | 2.7 |

In a preferred embodiment, the weight member 36, is comprised of tungsten or tungsten powder in a polymeric material. Preferably, the weight member 36 has weight between about 1 and 40 g. More preferably, the weight member has a weight of between about 20 and 40 g. Also, the weight member 36 preferably comprises greater than about 5% of the total weight of the club head 10.

In yet another embodiment of the invention, the weight member 36 can be selected from plurality of weight members having different weights from between about 1 g to 40 g. The weight members can be selected such that the over all club head weight can be set at a predetermined level. In one embodiment, the invention can comprise a plurality of weight members to selectively adjust the swing weight of the club head. In another embodiment, the weight members can be selected to adjust the overall club head weight to a predetermined weight. To account for manufacturing tolerance issues with regard to the casting of the club head. As can be appreciated by one of ordinary skill in the art, the weight member and the polymer can further be covered by a decorative medallion (not shown).

In accordance with the present invention, it will be appreciated that various aspects of the invention, as well as combinations thereof provide a golf club with an improved manner of redistributing weight from central portions of the golf club to perimeter portions of the clubhead, thereby increasing the face area and sweet spot without detrimentally altering overall weight or handling characteristics of the club.

What is claimed is:

1. A golf club head comprising:

a club face;

a back portion;

a recess defined by a perimeter wall in the back portion and a back surface of the club face;

a polymer material substantially filling the recess and attaching to the club head only by a perimeter surface bonded to the perimeter wall, wherein a predetermined void is defined directly between the back surface and the polymer material; and a medallion attached directly to the polymer material, the polymer mateilal having a first specific gravity and the medallion having a second specific gravity greater than the first, wherein upon an impact of the club head and a golf ball, a spring/mass type of vibration dampening is created that will cause the polymer and medallion to react and vibrate, whereby unwanted vibrations are dampened with respect to shear properties of the polymer material.

2. The golf club head of claim 1, wherein the polymer material is an epoxy.

3. The golf club head of claim 1, wherein the polymer material is a polyurethane.

4. The golf club head of claim 1, wherein the polymer material is a thermoset material.

5. The golf club head of claim 1, wherein the polymer material has an intrinsic damping coefficient of about 0.01 to 0.3 when tested at 1 Hz and 100 microns.

6. The golf club head of claim 1, wherein the polymer material has a Shore C hardness of about 40 to 60.

7. The golf club head of claim 1, wherein the polymer material has a Shore D hardness of less than 50.

8. The golf club head of claim 1, wherein the polymer material has a flexural modulus of less than 30,000 psi.

9. The golf club head of claim 1, wherein the polymer material has a glass transition temperature greater than 200° F.

* * * * *